United States Patent [19]

Boss

[11] 4,029,318

[45] June 14, 1977

[54] PORTABLE, ADJUSTABLE TARGET STAND

[76] Inventor: Richard K. Boss, 1677 - 32nd St. SW., Wyoming, Mich. 49509

[22] Filed: Sept. 19, 1975

[21] Appl. No.: 614,907

[52] U.S. Cl. ..... 273/102 S; 108/118; 248/164; 273/102 B

[51] Int. Cl.[2] ..... F41J 1/10

[58] Field of Search ..... 273/102 R, 102 B, 102 S, 273/102.4, 26 A, 181 F; 248/164, 432; 108/116, 118, 119; 40/125 G, 125 H

[56] References Cited

UNITED STATES PATENTS

| | | | |
|---|---|---|---|
| 920,907 | 5/1909 | Bolton | 273/181 F |
| 2,335,393 | 11/1943 | Bakanowski | 273/102 S |
| 2,890,051 | 6/1959 | Williams | 273/102 S |
| 2,915,314 | 12/1959 | Phillips | 273/26 A |
| 3,007,269 | 11/1961 | Jump | 40/125 H |
| 3,056,377 | 10/1962 | Nelson | 40/125 H |
| 3,087,701 | 4/1963 | Wallace | 273/102 S |
| 3,153,872 | 10/1964 | Walter | 40/125 H |
| 3,328,033 | 6/1967 | Hendry | 273/26 A |
| 3,430,954 | 3/1969 | Massey | 108/118 |
| 3,554,550 | 1/1971 | Schram | 273/102 R |
| 3,601,353 | 8/1971 | Dale | 273/102 S |
| 3,685,824 | 8/1972 | Quinn | 108/118 |
| 3,695,610 | 10/1972 | Thompson | 273/56 |
| 3,806,122 | 4/1974 | Jones | 273/102 S |
| 3,836,144 | 9/1974 | Mahoney | 273/26 A |
| 3,845,957 | 11/1974 | Lohr | 273/102 R |

*Primary Examiner*—Richard C. Pinkham
*Assistant Examiner*—Vance Y. Hum
*Attorney, Agent, or Firm*—McGarry & Waters

[57] ABSTRACT

A target stand comprises a target holder pivotably mounted on a scissors frame base. The scissors frame base and pivotably mounted target holder are adjustable, collapsible, and portable. The height of the target can be adjusted by extending or retracting the scissors frame base, with a cord or chain running from one side to the other side of the scissors frame base holding the base at its desired position. The target holder is held in position on the scissors frame base by an adjustable position support rod running from the target holder to the scissors frame base. Targets are held in place on the target holder by spring operated plastic clips which are slidably mounted on the target holder. The target stand can be securely attached to the ground by means of removable spikes on the bottom of the base.

16 Claims, 14 Drawing Figures

PORTABLE, ADJUSTABLE TARGET STAND

BACKGROUND OF THE INVENTION

1. Field of the Invention

This invention relates to a target stand and more particularly to a portable target stand that is adjustable to position a target at various heights above the ground by means of an adjustable scissors frame base.

2. Description of the Prior Art

A portable target stand is desirable for practicing target shooting while in the field. Such a target should be light weight, inexpensive and easily collapsible and portable. It is also desirable that the height of the stand be adjustable to permit target shooting practice from various positions, such as prone, sitting, and standing. The target stand also should be able to accommodate some variation in target sizes.

One portable target stand heretofore invented is shown in Williams U.S. Pat. No. 2,890,051. This patent discloses a target holder having a A-frame construction wherein some height adjustment is provided by means of telescoping legs on the frame. The width of the frame can be varied to hold different sizes of targets.

It is an object of the present invention to provide an improved portable target stand that is simple to erect and and adjust, provides a wide range of adjustment, is fabricated from inexpensive materials, and is constructed such that components can be easily replaced.

SUMMARY OF THE INVENTION

In accordance with the present invention, a portable, adjustable target stand comprises an extendible scissors base, including a pair of elongated base members pivotably connected together such that the height of the base is varied by a relative pivotal movement of the base members. A target holder for holding a target is mounted on the base in such a manner that the target holder can be positioned to hold the target in a generally vertical position on the base, regardless of the height of the base or the relative angular positions of the base members.

The base members of the target stand are U-shaped base members comprising a pair of legs and an upper portion extending between the ends of the legs at an upper end thereof. The legs have lower ends that engage the ground when the base is erected. The legs are pivotably connected together at a point between the ends thereof such that the base members form a scissors frame base.

A retaining mechanism is employed for selectively holding the base members at a plurality of relative angular positions, thereby holding the base at a plurality of selected heights. A linked chain or a knotted cord extending between the base members can be used as the retaining mechanism.

The target holder structure comprises a frame member having an open interior that is pivotably mounted on the upper portion of one of the U-shaped base member. A clamping mechanism for releasably mounting a target is mounted in the open interior of the frame member. An adjustable support mechanism extends between the frame member and the base for holding the target holder in a plurality of selected positions with respect to the base member. Desirably, the support mechanism is adapted to hold the target frame member in an upright position, regardless of the relative positions of the base members and regardless of the height of the base.

In one aspect of the present invention, the support mechanism comprises a rod extending between the target frame member and the opposite base member. The rod is pivotably attached to one of the members and engages a releasable spring clamp attached to the other member.

As an alternative to employing a releasable spring clamp for holding the rod in a variety of positions, the rod can be provided with a series of indentations along the length of the rod, and the other member can be fitted with a protrusion which is engageable with any one of the indentations to hold the target frame in its desired position.

A target is held in the target frame by means of a pair of spaced parallel rods that extend across opposite sides of the target frame member. The rods are releasably mounted in the target frame member so that they may be replaced easily if damaged. At least two spring clips are slidably mounted on each rod. The clips engage a target and suspend the target between the parallel spaced rods. The spring clips are resiliently held in place on the rods by rubber washers on each side of the spring clips, but the spring clips are easily slidable to different positions along the rods in order to accommodate different sizes of targets.

In one aspect of the present invention, the target frame member is a U-shaped member having the same general configuration as the U-shaped members employed for the base. The target frame is mounted on the base member by means of a pair of plastic clips which interconnect the lower portion of the target frame member with the upper portion of the base member. The plastic clips are attached to one member and releasably engage the other member, such that the target frame can easily be removed from the base member for repair or replacement.

These and other features and advantages of the present invention will hereinafter appear, and for purposes of illustration, but not of limitation, preferred embodiments of the present invention are described in detail below and shown in the appended drawings.

DETAILED DESCRIPTION OF PREFERRED EMBODIMENTS

Figure 1:
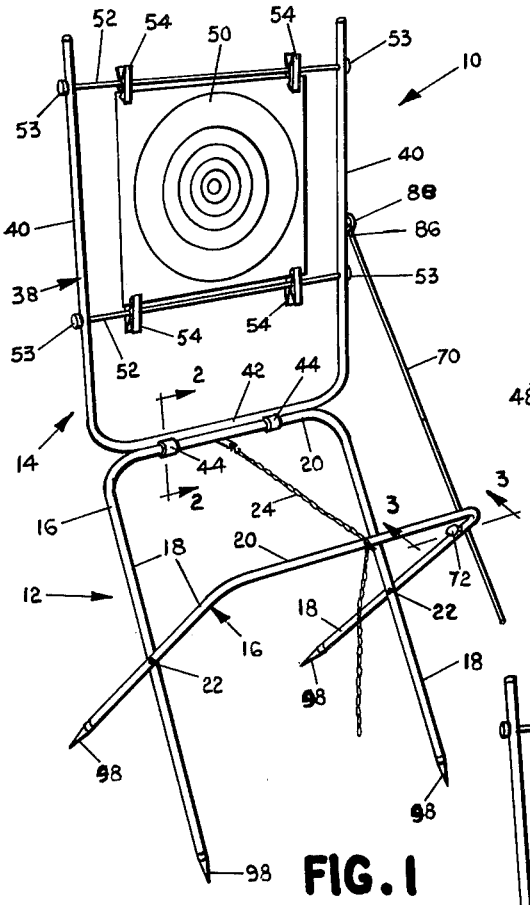
FIGS. 1, 4, and 5 are perspective views of the target stand showing three of the varying possible positions for use.

Referring now to the drawings, a target stand 10 constructed in accordance with the present invention comprises an extendable scissors frame base 12 and a target holder 14 pivotably mounted on the base.

Scissors frame base 12 comprises a pair of U-shaped tubular base members 16 having legs 18 and a upper portion 20 extending between the legs. Base members 16 are pivotably connected together by means of rivets 22 which extend through the legs on each side of the base members.

Figure 5:
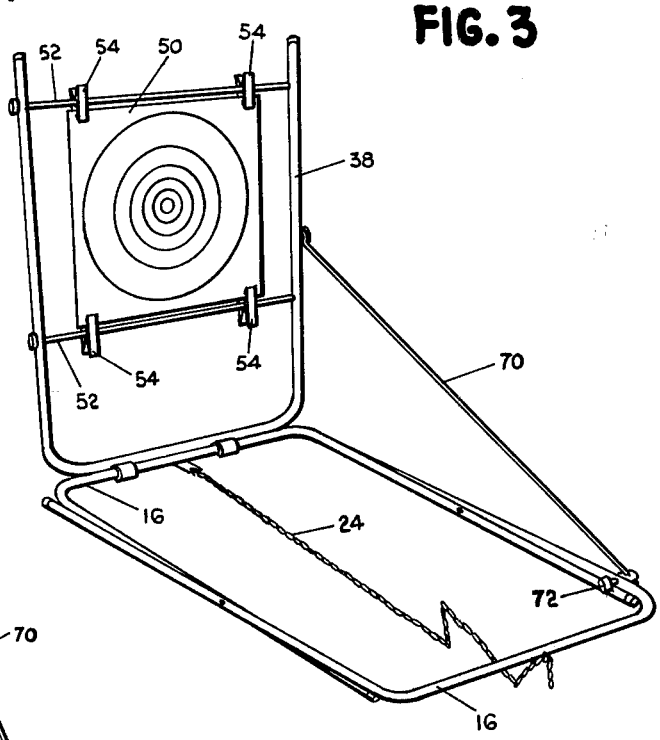
Figure 4:
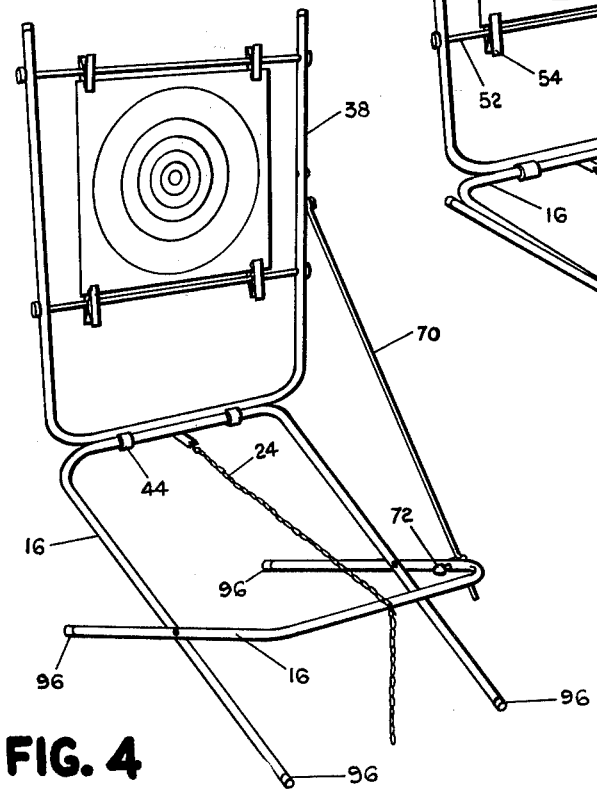
Figure 6:
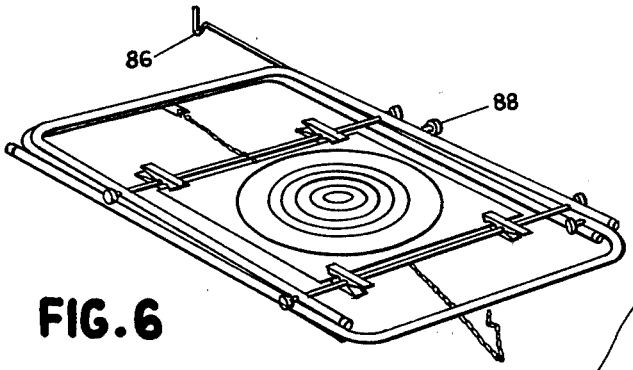
FIG. 6 is a perspective view of the target stand when it is fully collasped.

As shown in FIGS. 1, 4, and 5 the height of the scissors frame base may be adjusted by varying the relative positions of base members 16. By separating the upper portions 20 of the base members a greater distance, the overall height of the base is lowered. Conversely, by moving the upper portions together, the height of the base is raised.

Figure 10:
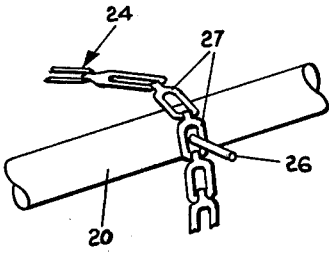
FIG. 10 is a fragmentary perspective view showing the use of a chain instead of a cord to hold the frame at a given height, with the view showing the manner in which the chain is held on the front member of the frame.

In order to hold the scissors frame base in any desired position, a retaining mechanism in the form of a link chain 24 extends between the upper portions 20 of the two base members. One end of the chain is attached securely to the upper end of one base member and the other end of the chain is releasably attached to the other base member. As shown in FIG. 10, this may be accomplished by means of a small projection 26 that extends outwardly from upper portion 20 such that the projection can be fitted into the opening in any one of the links 27 of the chain. A retaining mechanism of this type provides for adjustment of the height of the base from the fully collasped position, as shown in FIG. 5, to the fully erected position, as shown in FIG. 1.

Figure 9:
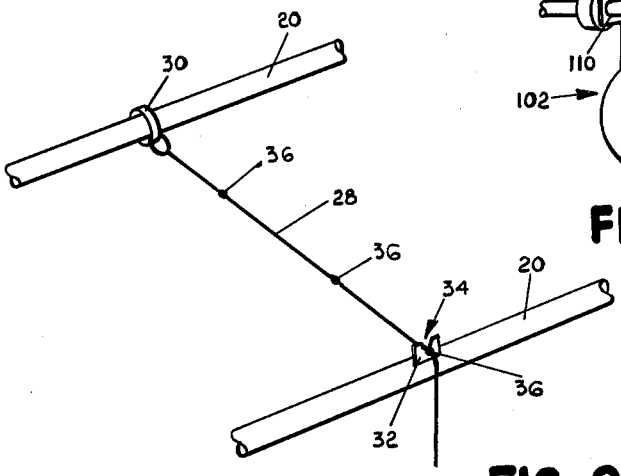
FIG. 9 is a fragmentary perspective view showing an adjustable cord that holds the scissors frame at its desired height.

A second embodiment of a retaining mechanism is shown in FIG. 9. In that figure, the retaining mechanism comprises a cord 28 formed of nylon or the like which extends from the top of one U-shaped member to the other. A loop is formed in one end of cord 28, and this loop is attached to a ring 30 that encircles the upper portion 20 of one of the U-shaped members. A clasp 32 having a V-shaped opening 34 is mounted on the upper portion of the other U-shaped member. Cord 28 fits into the V-shaped opening in the clasp, and a knot 36 in the cord prevents the cord from pulling through the clasp and thereby prevents the U-shaped base members from separating. A series of knots 36 can be made in the cord in order to provide for adjustment of the height of the base to any desired position.

Target holder 14 comprises a U-shaped tubular target support member 38 that is virtually identical to base members 16. Target support member 38 includes parallel legs 40 and cross member 42 extending between the lower ends of the legs.

Figure 2:
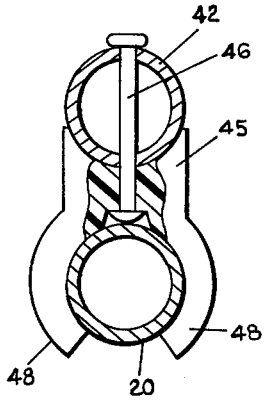
FIG. 2 is a cross-sectional view taken along line 2—2 of FIG. 1.

Cross member 42 is pivotally mounted on the upper portion 20 of one base members 16 by means of a pair of plastic clips 44. As shown in detail in FIG. 2, each plastic clip 44 includes an upper portion 45 that engages and is riveted to cross member 42. A rivet 46 extends through upper portion 45 and through cross member 42. The lower portion of clip 44 includes a pair of curved, spaced legs 48 that clip over and snugly engage the upper portion 20 of U-shaped member 16.

By employing releasable plastic clips of the type described herein, the target holder can be installed on and removed from the base simply and easily, and if the target holder is ever damaged, as by being struck by a bullet, the target holder can be removed and replaced simply and easily.

A target 50 is suspended in the interior of target holder 14 by means of a pair of spaced parallel rods 52 that extend between legs 40 of the U-shaped target support member 38. Rods 52 fit through openings in legs 40 and are held in place in the target support by means of removable rod tips 53 which fit snugly over the ends of the rods on the outside of the target support member. Frictional engagement of the rod tips on the rod holds the rods in place in the target holder. The rod tips may be removed in the event that it is necessary to replace rods 52. The easy replaceability of the rods, as well as other components of the present apparatus, is an important feature of the present invention.

Target 50 is suspended between rods 52 by means of conventional spring operated plastic clips 54. These clips are the same general design as employed for suspending wash from a clothes line and are readily available commercially.

Figure 11:
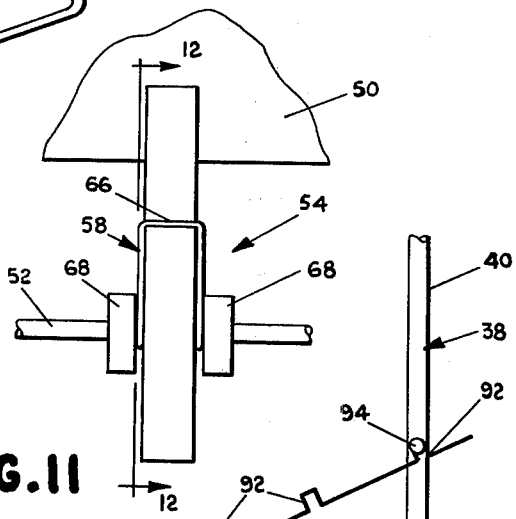
FIG. 11 is a partial front elevational view showing the clip mechanism employed to hold the target in place in the target holder.
Figure 12:
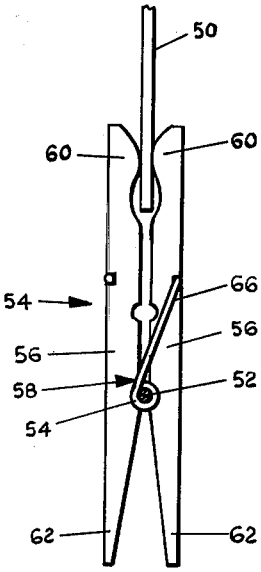
FIG. 12 is a view taken along line 12—12 of FIG. 11.

The details of plastic clips 54 are shown in FIGS. 11 and 12. Each plastic clip 54 includes two opposed arms 56, which are held together by means of a coil spring 58 positioned between the arms. The arms include opposed gripping surfaces 60 at one thereof and manually actuated lever arms 62 at the other end thereof. Coil spring 58 includes a coil spring section 54 positioned between the arms and L-shaped compression members 66 extending outwardly from each end of the spring into engagement with outer surface of each arm adjacent the gripping end of the clip. Coil spring 58 urges the gripping surface 60 of the clip into engagement with each other so as to resiliently hold target 50 in place. Lever arms 62 can be manually depressed in order to release the clip.

The target 50 is supported in the target holder by means of four spring clips, with two spring clips being slidably mounted on each rod 52. As shown in FIGS. 11 and 12, the rods fit through the coil spring sections 54 of each plastic clip. The plastic clips are thus slidable inwardly and outwardly along rods 52 in order to accomodate targets of different sizes. Rubber washers 68 are fitted over rods 52 on each side of each clip in order to hold the clip in its desired position. The rubber washers are held in position on the rod simply by the frictional engagement of the rubber washer with the rod. The positions of the rubber washers on the rod can be adjusted easily in order to change the position of the clips on the rod.

Target holder 14 is held in an upright position on base 12 by means of a support rod 70 that extends between target support member 38 and base 12. Support rod 70 is attached to one of the legs 40 of the target support members at a position spaced apart from the cross member 42, and the rod extends downwardly and outwardly to a spring loaded clamp 72 attached to the leg of the other U-shaped base member 16.

Figure 3:
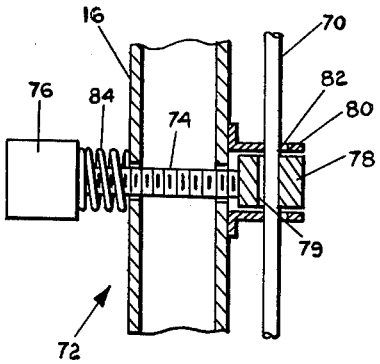
FIG. 3 is a cross-sectional view taken along line 3—3 of FIG. 1.

As shown in FIG. 3, clamp 72 comprises a bolt 74 that extends from a head 76 through an opening in base member 16 to a cylindrical plug 78 on the other end of the base member. Cylindrical plug 78 is threaded on the end of bolt 74. Plug 78 has a transverse rod opening therethrough. A cylindrical cap 80 fits over plug 78 and includes a transverse rod opening 82 therethrough that mates with opening 79 in plug 78. Rod 70 fits through rod openings 82 and 79. A compression spring 84 surrounding bolt 74 between head 76 and U-shaped member 16 urges bolt 74 and plug 78 to the lift (FIG. 3 orientation). Rod 70 is held a fixed distance from base member 16, so that plug 78 can move to the left only until the outer or right hand edge of opening 79 engages rod 70. When this occurs, plug 78 clamps rod 70 in place, and the frictional engagement of the plug with the rod prevents the rod from sliding longitudinally through the openings in the plug and the cylindrical collar. To release rod 70 to change the position of the rod, head 76 of the bolt is pushed to the right so that the openings 79 and 80 to become aligned. When in this position, the rod can slip easily between the openings.

The end of rod 70 that is attached to target support member 38 is mounted to the target support member by means of a U-shaped indentation 86 in the end of the rod that fits snugly over a solid pin 88 extending outwardly from U-shaped member 38. This provides a releasable connection between the rod and the support, so that the target support can be completely collasped downwardly onto the base.

It is important that the support member extending between the target holder and the base can be adjusted, so that the target support can be held in an upright position, regardless of the height of the base and angular positions of base members 16.

Figure 8:
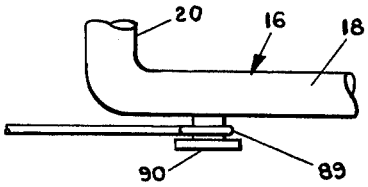
Figure 7:
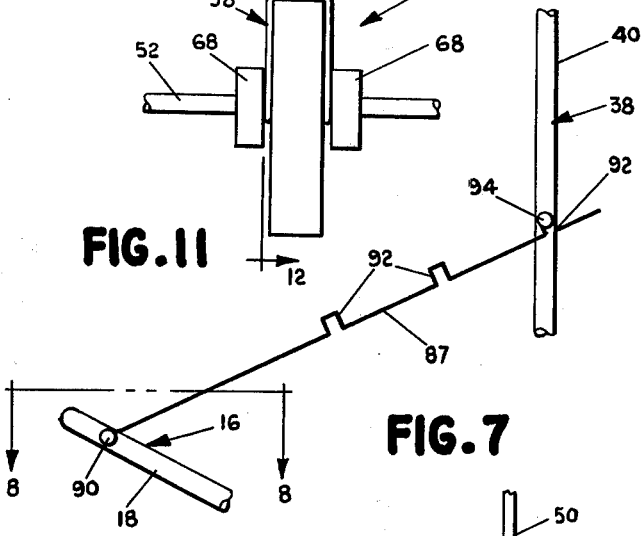
FIG. 7 is a fragmentary side-elevational view showing a second embodiment of a adjustment rod for holding the target holder in its desired position on the scissors frame.

Another type of support rod 87 for holding target support member 38 in an upright position with respect to base 12 is shown in FIGS. 7 and 8. Support rod 87 has a looped lower end 89 that fits over the shank of a pin 90 extending outwardly from base member 16. A series of indentations 92 are formed along the length of rod 87, and these indentations fit over a solid pin 94 on target support member 38.

By using a link chain 24 as the restraining mechanism and the continously adjustable straight rod 70 as the support mechanism for the target support member (as shown in FIG. 1) continuous adjustment in the height of the frame and the position of the target holder can be achieved. The use of knotted nylon cord 28 and indented rod 87 has a substitute for these elements limits the height adjustment of the base and the position adjustment of the target holder to a specific number of predetermined positions. However, this apparatus is less expensive than the continuously adjustable apparatus and provides adequate adjustment for most purposes. The principal positions that are desirable in a target stand of this nature are the standing positions (depicted in FIG. 1), the sitting position (depicted in FIG. 4), and the prone position (depicted in FIG. 5). Adjustment between these positions is possible with either adjustment mechanism shown herein.

To mount the target stand on the ground, the ends of legs 18 of U-shaped base member 16 may be capped with conventional protective caps 96. Alternatively, spiked feet 98 may be fitted on the ends of the legs in order to securely embed the target stand in the ground. The target stand can be fabricated so that the spiked feet 98 may be removed when desired and replaced with protective caps 96.

Figure 13:
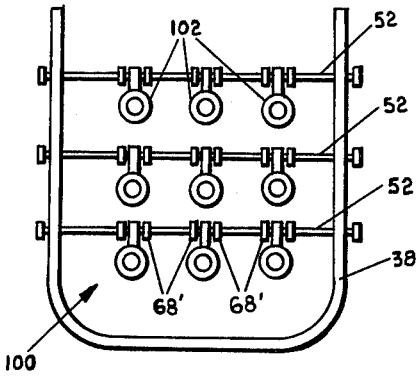
FIG. 13 is a front elevational view of the target holder on which a second type of target is mounted.
Figure 14:
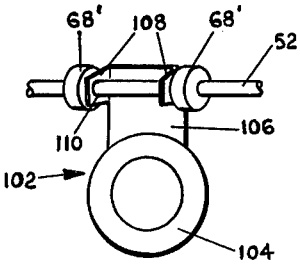
FIG. 14 is a fragmentary perspective view of one of the targets shown in FIG. 13.

A second type of target mechanism 100, particularly adapted for use with pellet or "B—B" guns, is shown in FIGS. 13 and 14. As shown in FIG. 13, a third transverse rod 52 is employed in addition to the upper and lower rods used for target 50. A series of individual targets 102 are pivotably mounted on the rods and are releasably held at a fixed position on the rods by resilient rubber washers 68', which are identical to washers 68 used to hold the spring clips in place.

As shown in FIG. 14, each target 102 comprises a circular target face 104 and a mounting bracket 106 extending upwardly from the top edge of the target face. Mounting bracket 106 includes a pair of spaced ears 108 extending at right angles to the target face and includes aligned apertures 110 which pivotally fit over rod 52.

With the targets hanging from the rods in this manner, when the targets are struck by a pellet or a "B—B", the targets spin around the rod. This target arrangement can be used as a game, with the targets being of different sizes and each size equal to a different point score.

As described herein, the target stand of the present invention is widely adjustable between a wide range of target heights and positions, and the target stand is fully collapsible and portable. Moreover, the target stand is inexpensive and is fastened together in such a manner such that almost any part of the system can be removed and replaced with a minimum of inconvenience, in the event that any part is struck by a bullet or damaged in any other manner. Furthermore, most of the components of the present system are inexpensive and readily available items, so that replacement parts can be fashioned by the owner of the target stand himself, when factory produced replacement parts are not available.

It should be understood that the embodiments described herein are merely exemplary of the preferred practice of the present invention and that various changes and modifications may be made in the arrangements and details of construction of these embodiments without departing from the spirit and scope of the present invention.

The embodiments of the invention in which an exclusive property or privilege is claimed as follows:

1. A portable target stand for a firearm target comprising:

an extendible scissors frame base including a pair of elongated base members pivotably connected together at a pivot point between the ends thereof such that the height of the base is varied by relative pivotal movement of the base members, each base member having an upper portion extending above the pivot point thereof, the upper portions of the base members comprising an upper portion of the base;

target holder means for holding a target pivotably mounted on the upper portion of the base in such a manner that the target holder means can be positioned to hold the target in a generally vertical position on the base regardless of the height of the base or the relative angular positions of the base members; and support means extending between the target holder means and the base for holding the target holder in at least one selected position with respect to the base, said support means providing a rigid, pivot-preventing interconnection between the base and the target holder means at points spaced away from the pivotal axis of the target holder means on the base at each said selected position.

2. A target stand according to claim 1 wherein the target holder comprises a frame having an open interior with at least one target supporting rod extending across the frame and being removably mounted on opposite sides of the frame, at least one target being pivotally mounted on each rod for pivotal rotation around the rod, each target comprising a mounting bracket pivotally mounted on the rod and a solid target face attached to the mounting bracket and hanging below the rod.

3. A target stand according to claim 2 wherein the target holder includes three parallel spaced rods extending across the frame and a plurality of targets pivotally mounted on each of the rods, the targets being slidable along the rods but being releasably held in place at spaced positions along the rods by resilient washers mounted on the rods on each side of each target, the washers being releasably held in place by frictional engagement of the washers with the rods.

4. A target stand according to claim 1 wherein the support means is sufficiently adjustable so as to be capable of holding the target holder in a plurality of selected positions with respect to the base, said selected positions including vertical positions at varied predetermined base heights.

5. A target stand according to claim 1 and further comprising retaining means extending from one base member to the second base member for selectively holding the base member at a plurality of relative angular positions so as to hold the base at a plurality of selected heights.

6. A portable, adjustable target stand for a firearm target comprising:

an extendible scissors frame base including a pair of elongated U-shaped base members, each said base member comprising a pair of legs and an upper portion extending between the ends of the legs at upper ends thereof, the legs having lower ends that engage the ground when the base is erected, the legs being pivotably connected together at a point between the ends thereof such that the base members form a scissors frame base;

retaining means for selectively holding the base members at a plurality of relative angular positions so as to hold the base at a plurality of selected heights; and target holder means for holding a target comprising a frame member having an open interior, with clamp means for releasably mounting a target being mounted in the open interior of the frame member, the frame member being pivotably mounted on the upper portion of one base member in such a manner as to position the target in a generally vertical position on the base regardless of the height of the base or the relative angular positions of the base members, an adjustable support means extending between the frame member and the base for holding the target holder means in a plurality of selected positions with respect to the base member on which it is mounted, said support means providing a pivot-preventing interconnection between the base and the target holder means at points spaced away from the pivotal axis of the target holder means on the base at each said selected position.

7. A target stand according to claim 6 wherein the retaining means and support means are sufficiently adjustable to permit the target stand to be collasped to a substantially flat condition or to be erected to sufficient heights to permit target practice from prone, sitting, and standing positions, with the target holder being maintained in a generally vertical position when the target stand is in each position.

8. A target stand according to claim 7 wherein the support means comprises a rod that extends between the frame member and the U-shaped base member opposite to the one the frame member is mounted on, the rod being pivotally connected to one member and being releasably held to the other member be means of a spring operated clamp, the clamp holding the rod at any desired longitudinal position along the rod and being releasable to permit the rod to be moved to a different longitudinal position.

9. A target stand according to claim 7 wherein the support means comprises a rod that extends between the frame member and the U-shaped base member opposite to the one the frame member is mounted on, the rod being pivotally attached to one member and being releasably attachable to one point on the other member at a plurality of positions along the rod, the other member including an outwardly extending projection at said one point and the rod including a plurality of indentations along the rod, each indentation being capable of fitting over the projection to releasably hold the rod at a fixed longitudinal position on said other member.

10. A target stand according to claim 7 wherein the retaining means comprises a linked chain extending between the base members, the chain being attachable to each base member so as to prevent the base members from spreading apart past a predetermined point, said chain being releasably attachable to at least one base member such that it may be attached to the base member at a number of predetermined points along the chain, thereby varying the distance that the base members are permitted to spread apart before being restrained by the chain.

11. A target stand according to claim 10 wherein the chain is releasably attached to the base member by means of a stud that extends from the base member, the links of the chain fitting over the stud to lock the chain in a fixed position on the base member.

12. A target stand according to claim 2 wherein the retaining means is a cord that extends between the base members, the cord being releasably attached to at least one of the base members so as to permit the cord to be attached to said base members at a plurality of longitudinal positions along the cord, the cord being attachable to said base member by a plurality of knots in the cord that are releasably engagable with a clasp mounted on said base member.

13. A target stand according to claim 6 wherein the target holder further comprises:

a pair of spaced parallel rods releasably attached to opposite sides of the frame member and extending across the frame; and at least two releasable clip means mounted on each rod for suspending a target between the rods, the clip means being slidable along the rods such that different sizes of targets can be held by the clip means.

14. A target stand according to claim 6 wherein the frame member is mounted on the base member by means of releasably clip means, the clip means being attached to one member and being releasably clipped over the other member in such a manner that one member can be pivoted about the other member.

15. A target stand according to claim 6 and further comprising spiked feet removably attached to the ends of the base members that engage the ground.

16. A portable, adjustable target stand comprising:

a base including a pair of tubular, U-shaped base members comprising parallel legs and an upper portion extending between upper ends of the legs, the legs of said base members being pivotally connected together in scissors fashion;

retaining means extending between the upper portions of the base members for limiting the relative distance that the base members may be spread apart, the retaining means being adjustable to vary said distance;

a tubular U-shaped target frame member pivotably mounted on the upper portion of one of the base members, said target frame member having a pair of spaced parallel legs and a lower portion extending across the lower ends of said legs, the lower portion of the target frame member being adjacent to and parallel to the upper portion of the base member;

plastic clip means pivotally connecting the lower portion of the target frame member with the upper portion of the base member, the plastic clip means being releasably clipped to at least one member;

support means extending between the target frame member and the opposite base member for holding the target frame member in an upright position on the base and including interconnection means for preventing pivotal movement of the target frame member with respect to the base said support means including a rod attached at one end to one member and being releasably attachable to the other member at a plurality of longitudinal positions along the rod;

a pair of spaced parallel rods extending between the legs of the target frame member, said rods being releasably attached to the target frame member; and at least two spring clip means slidably mounted on each rod for suspending a target between the rods, said spring clip means being resiliently held in position on the rod but being slidable to different positions to accommodate different sizes of targets.

* * * * *